United States Patent [19]

Geis et al.

[11] Patent Number: 4,533,094

[45] Date of Patent: Aug. 6, 1985

[54] MORTAR SYSTEM WITH IMPROVED ROUND

[75] Inventors: Norman P. Geis, Kensington, N.H.; Edward A. Chambers, Acton, Mass.

[73] Assignee: Raytheon Company, Lexington, Mass.

[21] Appl. No.: 643,758

[22] Filed: Aug. 23, 1984

Related U.S. Application Data

[63] Continuation of Ser. No. 434,783, Oct. 18, 1982, abandoned.

[51] Int. Cl.[3] ..... F42B 13/32

[52] U.S. Cl. ..... 244/3.22; 244/3.24

[58] Field of Search ..... 244/3.16, 3.22, 3.24; 102/374, 376, 445

[56] References Cited

U.S. PATENT DOCUMENTS

| | | | |
|---|---|---|---|
| 3,070,018 | 12/1962 | Fahl | 102/378 |
| 3,374,967 | 3/1968 | Plumley | 244/3.22 |
| 3,706,281 | 12/1972 | Hatakeyana | 102/378 |
| 3,903,803 | 9/1975 | Losey | 102/378 |
| 3,970,006 | 7/1976 | Copeland et al. | 102/374 |
| 4,096,802 | 6/1978 | Waln | 102/215 |
| 4,240,596 | 12/1980 | Winderman | 244/3.19 |
| 4,347,996 | 9/1982 | Grosso | 244/3.22 |
| 4,407,465 | 10/1983 | Meyerhoff | 244/3.16 |
| 4,408,735 | 10/1983 | Metz | 244/3.22 |

FOREIGN PATENT DOCUMENTS

| | | | |
|---|---|---|---|
| 2714688 | 10/1977 | Fed. Rep. of Germany | 244/3.16 |
| WO81/00908 | 4/1981 | PCT Int'l Appl. . | |

*Primary Examiner*—Charles T. Jordan

*Attorney, Agent, or Firm*—Philip J. McFarland; Joseph D. Pannone

[57] ABSTRACT

An improved round for a mortar is shown to include a streamlined, jettisonable nose covering a hemispherical infrared (I.R.) dome incorporated in a gyroscopically stabilized I.R. seeker, deployable wings and a jet control arrangement; during the initial phases of flight the streamlined nose is in place and the deployable wings are deployed so that the aerodynamic characteristics of the round are similar to those of a conventional round, but, in the terminal phase of flight, when the nose is jettisoned the jet control arrangement may be operated in response to commands from the I.R. seeker to direct the round to impact on the top of a selected target.

1 Claim, 2 Drawing Figures

MORTAR SYSTEM WITH IMPROVED ROUND

This application is a continuation of application Ser. No. 434,783 filed Oct. 18, 1982 now abandoned.

BACKGROUND OF THE INVENTION

This invention pertains generally to weapon systems and, in particular, to an improved weapon system using mortar projectiles having self-contained guidance systems to interdict armored vehicles.

As is known, modern armored vehicles are all characterized by a high degree of mobility. When many such vehicles are deployed in an engagement, an opposing land force equipped with known "anti-armor" weapon systems is extremely vulnerable, especially if a relatively high level of loss of vehicles is acceptable. That is to say, to survive an attack by massed forces of modern armored vehicles, an opposing land force must be equipped with a weapon system that can, inter alia, achieve a high degree of lethality by exploiting minor defects in the protective armor of modern armored vehicles without requiring exposure to direct fire from the armored vehicle.

Current anti-armor weapon systems used by land forces generally utilize direct line-of-sight guidance techniques wherein a gunner is required to keep a set of "cross-hairs" in an optical tracker on the intended target while simultaneously providing guidance commands to a wire-guided missile to maintain the missile centered within the "cross-hairs". Because a direct line-of-sight to the intended target is required, the gunner may be exposed to counterfire during launch and flight of the missile. The advantage of camouflage which may initially screen the gunner is offset by the fact that the velocity of the counterfire from the intended target is from three to five times faster than current anti-armor weapons. Furthermore, explosions from large gun rounds impacting close to a gunner near the end of the flight time of a wire-guided missile may cause the gunner to flinch so that the intended target is missed. Furthermore, because known anti-armor systems are direct line-of-fire systems, the wire-guided missiles of such systems will generally impact on the front or sides of the intended targets. The front and sides of tanks and other armored vehicles are generally more heavily armored than the top or rear and therefore the lethality of known anti-armor systems is degraded.

SUMMARY OF THE INVENTION

With this background of the invention in mind it is therefore a primary object of this invention to provide an anti-armor weapon system having improved lethality.

It is another object of this invention to provide an anti-armor weapon system capable of sustaining a high rate of fire.

It is yet another object of this invention to provide an anti-armor weapon system that is less vulnerable to enemy counterfire.

These and other objects of this invention are generally attained by providing a mortar projectile having a self-contained guidance system capable of searching for, acquiring and tracking an armored vehicle and developing the requisite guidance signals to impact the target vehicle on its top or most vulnerable surface. The mortar projectile comprises a g-hardened two-color infrared (I.R.) seeker within a jettisonable nose cone, a jet reaction control system and a set of deployable wings. The contemplated mortar projectile is designed to be interchangeable with the standard round fired by a M30 mortar (107 millimeters diameter) with similar flight characteristics during the first half of flight. Adaptation to the larger 120 millimeter mortars is readily made by incorporating a larger warhead at the back end and four bore riders of the forward end of the projectile. After launch the wings are deployed to reduce spin rate and to provide lift, and then, after passing apogee, the nose cone is jettisoned. The two-color I.R. seeker then is operated to discriminate against natural false targets and countermeasures, so that the mortar projectile may be guided to impact on the top of a selected target from a distance of up to 2 kilometers with a miss distance of less than 1 meter. The jet reaction control system comprises a warm gas generator fueled with solid propellant supplying a requisite gas flow to diametrically opposed pairs of side thrusting jets at the forward end of the mortar projectile to provide any required maneuvering during terminal phase of flight.

BRIEF DESCRIPTION OF THE DRAWINGS

Other objects and many of the attendant advantages of the invention will be readily appreciated as the same become better understood by reference to the following detailed description when considered in connection with the accompanying drawings wherein.

DESCRIPTION OF THE PREFERRED EMBODIMENT

Figure 1:
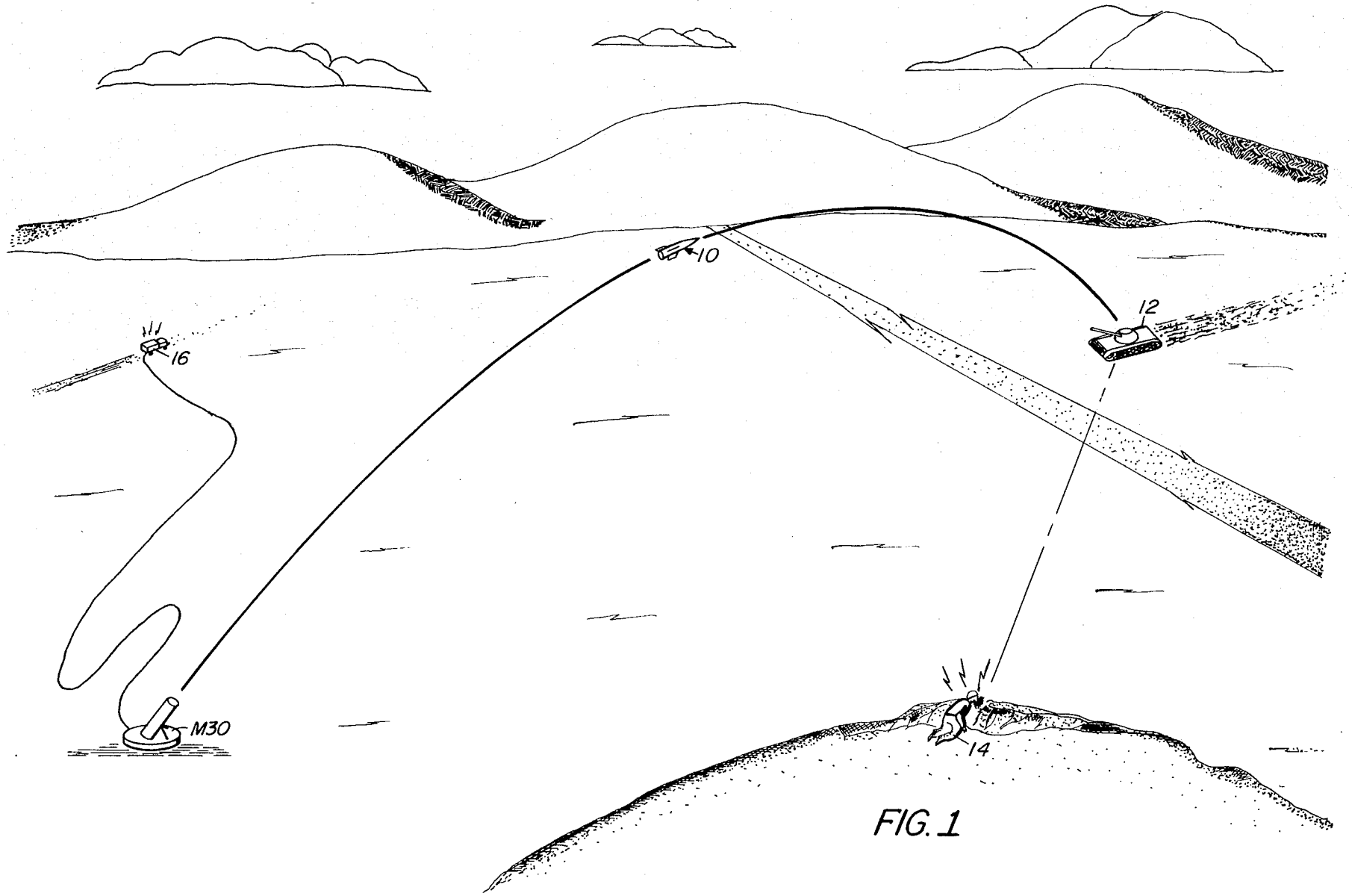
FIG. 1 is a sketch of an exemplary tactical engagement in which a guided mortar projectile according to this invention may be utilized to destroy an armored vehicle.

Referring now to FIG. 1, an exemplary engagement is illustrated in which a guided mortar projectile 10, as contemplated in this invention, is utilized to interdict an armored vehicle (here a tank 12). Thus, a forward observer 14 in a known location determines the range and bearing of the tank 12 in any known manner and relays such information to a fire control center 16. On the basis of the observed range and bearing information and the known position of the forward observer 14, the trajectory of a guided mortar projectile 10 to intercept the tank 12 is computed in any known manner at the fire control center 16. Aiming and firing commands are then transmitted to the crew (not shown) of an armored mortar carrier (also not shown) at a known position and equipped with an M30 mortar so that a guided mortar projectile may be fired with the requisite propellant to an aiming point (not shown) in the vicinity of the tank 12.

Figure 2:
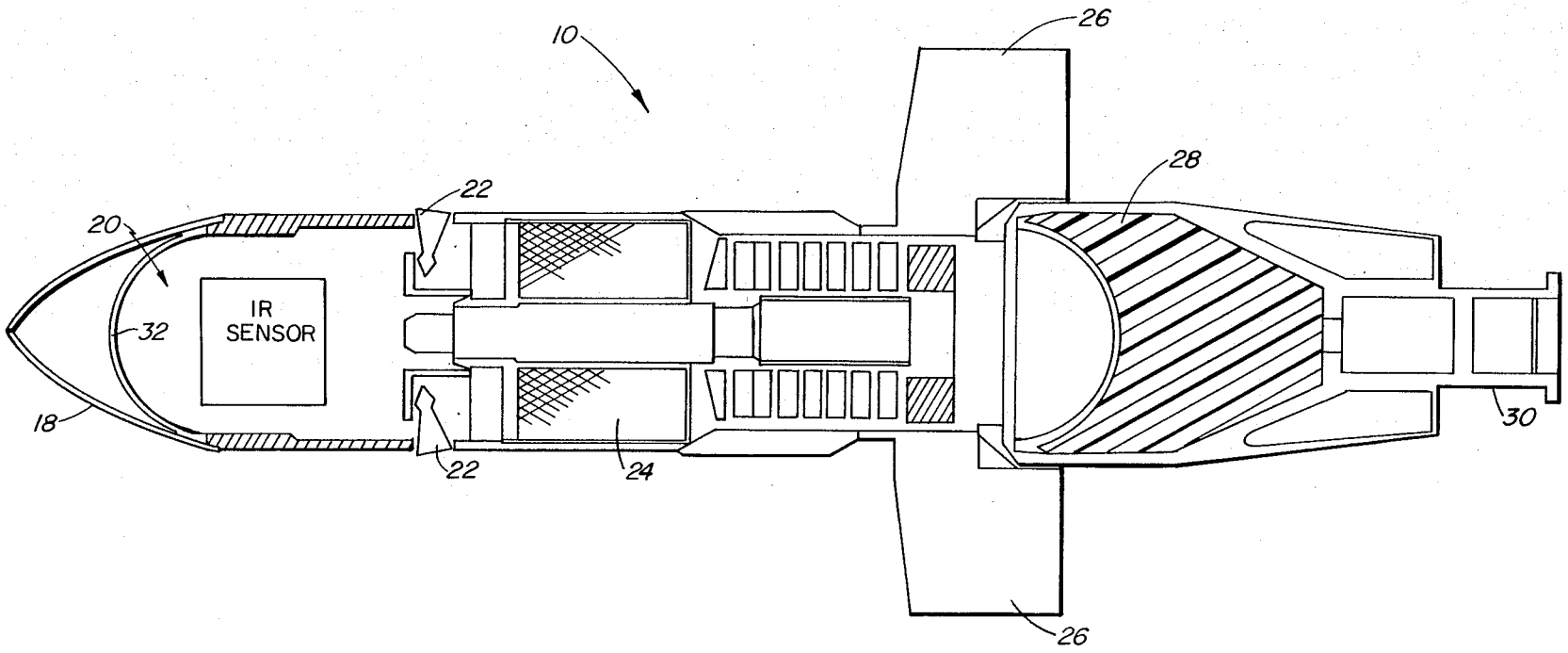
FIG. 2 is a longitudinal cross-sectional view, somewhat simplified, of the guided mortar projectile used in FIG. 1.

Referring now to FIG. 2, the guided mortar projectile 10 is shown to include a jettisonable nose 18 shaped as an ogive and overlying a known infrared (I.R.) seeker 20. A forward jet reaction control system (not numbered), including diametrically opposed pairs of side thrusting nozzles 22 and a gas generator 24, is mounted directly behind the I.R. seeker 20. Spring-loaded wings 26 (shown in extended positions) are initially disposed within a recess (not numbered) provided in the body of the guided mortar projectile 10. A shaped-charge warhead 28 is provided in the aft portion of the guided mortar projectile 10. Protruding from the rear of the mortar projectile 10 is a tube 30 which serves as the propellant igniter. The boosting propellant, all of which is totally burned within the mortar tube (or barrel of the M30 mortar), is initially in the form of propellant wafers (not shown) suspended on the tube 30. The guided mortar projectile 10 is fitted with the number of propellant wafers (not shown) to achieve maximum range, the range to the aiming point then determining how many propellant wafers are removed before firing. An obturator (not shown) which deforms under pressure to seal against the barrel of the M30 mortar is also provided on the rear of the guided mortar projectile 10.

An infrared (I.R.) dome 32 (here a conventional hemispherical dome of zinc sulfide) is provided in front of the I.R. seeker 20. The blunt shape of such dome has such a high drag coefficient that the velocity of the guided mortar projectile 10 would be significantly reduced during flight. Therefore, during the initial stage of flight the streamlined nose 18 (here ogival and jettisonable) is provided to match the ballistics of the mortar projectile 10 to that of a standard high-explosive round of the M30 mortar. The streamlined nose 18, fabricated from molded plastic and formed from two half-sections for ease of separation, additionally provides protection to the dome 32 during prelaunch and the initial phases of flight. When the mortar projectile 10 reaches the apogee of its trajectory, the streamlined nose 18 is jettisoned and the I.R. seeker 20 is actuated. As previously mentioned, the streamlined nose 18 is fabricated from two half-sections which are latched together in any known way. Explosive squibs (not shown, but of known construction) may be fired to unlatch the two half-sections when desired, thereby allowing a spring-loaded mechanism (not shown) to separate the two half-sections from each other and from the mortar projectile 10.

As shown in detail in U.S. patent application Ser. No. 334,670, filed Dec. 4, 1981 and assigned, by mesne assignment, to the same assignee as the present invention, the I.R. seeker 20 here is a two-color device. Briefly, the I.R. seeker 20 comprises an optical system supported on a free gyroscope (sometimes hereinafter referred to as an optical-free gyroscope). Thus, a spherical bearing supports a rotor having permanent magnets that interact with motor drive coils to form an electric motor. The rotor floats on a layer of low pressure (100 p-s-i) nitrogen supplied through equatorial orifices (not numbered) provided in the spherical bearing. An optical system (comprising a primary mirror, a secondary mirror, a tertiary mirror, a Porro prism and a corrector lens) is affixed to the rotor so as to focus incident I.R. energy on a planar array of I.R. detectors disposed behind a window provided on a refrigerated detector unit (RDU).

The spin axis of the optical-free gyroscope before firing of the mortar projectile 10 is coincident with the longitudinal axis of such projectile. Precession and caging coils are provided to gimbal the optical-free gyroscope to a limit of $\pm 15°$ about the pitch and yaw axes during flight. The spin speed of the optical-free gyroscope is controlled by measuring the outputs of Hall effect sensors and using the sensed signals to set levels in the motor drive coils.

With the exception of the dome 18 and the refrigerated detector unit, the entire optical system spins and precesses (gimbals) along with the rotor. The optical system is designed to image radiation from both a target band and a guard band on the detector array within the RDU at the gimbal center. The Porro prism produces an image inversion that results in image rotation about the optical axis as such prism spins. The optical image rotation rate then is twice the mechanical prism rotation rate (here 70 Hz). A series of detector elements (not shown) are used in both the target and the guard spectral bands. Each detector element (not shown) effectively scans an annular region with corresponding elements in both spectral bands covering the same region. The field of view scanned is here an annulus with an outer diameter of 52 milliradians and an inner diameter of 28 milliradians.

The contemplated signal processing and control electronics have been described in detail in a co-pending application Ser. No. 106,811 filed Dec. 26, 1979 and assigned to the same assignee as the present invention, and will, therefore, not be recounted here. Suffice it to say that the use of both a target and a guard spectral band enable the I.R. seeker 20 to distinguish between returns attributable to both false targets and countermeasures from those from a true target.

As mentioned briefly hereinabove, once the mortar projectile 10 has reached its apogee, the streamlined nose 18 is jettisoned. The wings 26 are deployed at launch to reduce the spin of the mortar projectile 10. Prior to deployment the wings 26 are folded within the recess (not numbered) provided in the body of the mortar projectile 10 and are banded to remain closed. A small explosive squib (not shown) is mounted inboard of the band (also not shown) so that when the explosive squib is fired the band is severed so the wings 26 may be deployed. It should be noted here in passing that the firing signals provided to the squibs (not shown) associated with both the streamlined nose 18 and the wings 26 may be supplied by a simple timer. That is to say, because the trajectory that the mortar projectile must fly is known prior to firing, the time during flight at which the squibs are to be fired may be calculated prior to firing the projectile 10. The timer (not shown) within the control electronics (also not shown) need only then count down from firing an appropriate elapsed time to provide the requisite firing signals.

Once the mortar projectile 10 has reached apogee the streamlined nose 18 is jettisoned, allowing the I.R. seeker 20 to begin a search, or acquisition, mode of operation. In connection with such operation, it will be appreciated that the mortar projectile 10 follows a highly arched trajectory, reaching apogee during any flight at approximately 3,000 meters above the local ground terrain and then following a steep flight path angle at a velocity of approximately 200 meters per second to intercept the tank 12 (FIG. 1) on its top (or most vulnerable surface). The I.R. seeker 20 therefore is arranged to execute a spiral search pattern covering the base of a 20° cone on the underlying terrain. Such search pattern, executed by gimbaling the optical-free gyroscope, is repeated once every two seconds. While the search pattern is being executed at a two second rate, the Porro prism is rotated to scan the annular field of view of the I.R. seeker 20 every 7 milliseconds.

Once a valid target is detected in a manner described in detail in the above-referenced patent application, the I.R. seeker 20 will automatically switch from a search to a track mode. In the track mode, target line-of-sight information is provided by the I.R. seeker 20 to a digital computer (not shown, but which here is a Model 2900 microprocessor from Advanced Micro Devices, 401 Thompson Place, Sunnyvale, Calif. 94086, which computes the requisite trajectory changes to enable the mortar projectile 10 to home on the target centroid by means of the well known proportional navigation law. If a valid target return signal is lost for any reason, the I.R. seeker 20 will again commence the search pattern until the same or another valid target is detected.

As previously mentioned, the terminal guidance phase of the mortar projectile 10 is initiated after the latter has reached its trajectory apogee which is computed on a preset time from launch basis. It should be noted here that nitrogen gas is also supplied to the refrigerated detector unit to cool the detector array. The nitrogen to the RDU is supplied immediately at launch of the mortar projectile 10 to assure that the detectors will be sufficiently cooled upon entering the terminal guidance phase. As also mentioned previously, after the mortar projectile 10 is launched, the spring-loaded wings 26 are deployed. This converts the mortar projectile 10 from a spin-stabilized device to a roll-rate constrained device requiring static aerodynamic stability and a conventional cyclical pitch/yaw control maneuvering system. It should be noted here in passing that the positioning of the spring-loaded wings 26 affects the degree of stability provided to the mortar projectile 10. That is to say, if the folded wings 26 are positioned too far aft, the stability of the mortar projectile 10 may become so great that the forward jet reaction control system (not numbered) may not produce the requisite pitch and yaw control moments.

The contemplated fluidic reaction jet control arrangement is here a Model 710890 provided by Garrett Pneumatic Systems Division, 111 South 34th Street, Phoenix, Ariz. 85010. Briefly, such an arrangement comprises a hot gas generator 24 feeding a pair of pulse-duration modulated, solenoid controlled, vortex valves to regulate the flow from the thrust nozzles 22. Such nozzles are positioned at the maximum possible distance from the center of gravity of the mortar projectile 10 in order to obtain the maximum control moment for a given jet force. Consequently, the thrust nozzles 22 are placed directly behind the I.R. seeker 20. The solenoid controlled, vortex valves are controlled by analog signals provided by a digital computer (not shown) through digital-to-analog converters (also not shown), thereby closing the guidance control loop through the I.R. seeker 20. That is to say, the I.R. seeker 20 gyroscopically stabilizes the line-of-sight with respect to inertial space. Since the I.R. seeker 20 is here mechanized in a first order tracking loop, the boresight error outputs from the I.R. seeker 20 are proportional to line-of-sight rates in inertial space. Consequently, a simple error multiplication process within the digital computer (not shown) is sufficient to implement a form of the proportional navigation guidance law. The commands from the digital computer (not shown) to the fluidic reaction jet control system (also not shown) result in a lateral acceleration being exerted on the mortar projectile 10 to steer it toward a selected target.

One problem associated with the use of the shaped charge warhead 28 is that the mortar projectile 10 must impact on the top of the target. The ability to achieve this accuracy is dependent on the homing time available for removing the intercept heading error present at target acquisition, the speed of response of the guidance loop, and the lateral acceleration capability of the fluidic reaction jet control system. The nature of the trajectory flown and the characteristics of the passive I.R. seeker 20 restrict the available homing time to between 3 to 10 seconds, while the stability provided by the spring-loaded wings 26 limit the maneuvering capability of the mortar projectile 10 to about 5 to 7 g's of trim. Normally, biases in the open loop guidance mechanism may cause significant trajectory perturbations that will increase miss distance beyond an acceptable limit. Here, however, because the spring-loaded wings 26 allow the mortar projectile 10 to roll at a rate greater than its natural frequency, the mortar projectile 10 will not have time to respond to any biases before rolling to a new plane so the effect of any bias effectively is cancelled.

Referring back now for a moment to FIG. 1, it should now be appreciated that a mortar projectile according to this invention is capable of sustaining a high rate of fire to interdict a massed armor attack. Further, because each mortar projectile 10 contains its own guidance system, the mortar cannon may be moved between firing sequences to avoid hostile counterfire.

Having described a preferred embodiment of this invention, it will now be apparent to those of skill in the art that many changes may be made without departing from the inventive concepts. Thus, for example, in some engagements it may be desirable that the mortar projectile 10 fly a flatter trajectory. In such a case the ogive nose 18 need not be utilized as the mortar projectile 10 would exit the muzzle as a subsonic velocity. Further, the I.R. seeker 20 may be provided with a third spectral band to provide even greater discrimination against false targets and countermeasures. It is felt, therefore, that coverage should not be limited to the disclosed embodiment, but rather should be limited only by the spirit and scope of the appended claims.

What is claimed is:

1. In a mortar system, an improved round adapted to be guided during the terminal phase of flight its, said round comprising:

(a) a mortar shell having a first and a second nose cone, said first cone shaped as an ogive overlying said second cone, said second cone shaped as a hemisphere and fabricated from a material substantially transparent to infrared energy, said shell being spin-stabilized during the initial stage of flight its;

(b) an infrared seeker, mounted in said shell behind the second nose cone and gyroscopically stabilized to derive boresight error signals proportional, in inertial space, to the line-of-sight rate between said round and a selected target;

(c) wings, deployed from the rear of the mortar shell during the terminal phase of flight the of said round, to decrease the roll rate of said shell below the rate required for spin stabilization; and, (d) jet control means, responsive to the boresight error signals out of the infrared seeker, to change the flight path of said shell to null said boresight error signals.

* * * * *